United States Patent [19]

Cook

[11] 3,945,364

[45] Mar. 23, 1976

[54] ROTARY VALVE FOR INTERNAL COMBUSTION ENGINE

[76] Inventor: Danny G. Cook, 128 Los Altos, Walnut Creek, Calif. 94598

[22] Filed: June 24, 1974

[21] Appl. No.: 482,648

[52] U.S. Cl.... 123/190 BD; 123/80 BA; 123/190 D

[51] Int. Cl.[2] ..... F01L 7/00

[58] Field of Search ..... 123/190 R, 190 A, 190 BD, 123/190 B, 190 BE, 190 D, 80 R, 80 BA

[56] References Cited

UNITED STATES PATENTS

| | | | |
|---|---|---|---|
| 1,087,499 | 2/1914 | Lane | 123/190 BD |
| 1,278,083 | 9/1918 | Force | 123/190 BD |
| 1,304,039 | 5/1919 | Goldbeck | 123/190 BD |
| 1,649,235 | 11/1927 | Jones | 123/190 BD |
| 2,857,902 | 10/1958 | Van Vorst | 123/190 BD |
| 2,895,459 | 7/1959 | Sbaiz | 123/190 BD |

FOREIGN PATENTS OR APPLICATIONS

| | | | |
|---|---|---|---|
| 437,781 | 11/1935 | United Kingdom | 123/190 BD |
| 819,264 | 1/1956 | United Kingdom | 123/190 BD |

*Primary Examiner*—Charles J. Myhre
*Assistant Examiner*—Daniel J. O'Connor
*Attorney, Agent, or Firm*—Flehr, Hohbach, Test

[57] ABSTRACT

An internal combustion engine employing a rotary valve having a single passage which is adapted to provide both intake and exhaust valving functions. The valve is formed with a circular outer periphery and is mounted for rotation about a transverse axis between intake and exhaust ports which are provided at the head end of the combustion chamber. The passage is defined by a concaval recess which extends across a chord of the valve periphery. Means is provided for rotating the valve in timed relationship with movement of a piston within the chamber so that the passage moves into simultaneous register with the intake port and combustion chamber during the intake phase, and into simultaneous register with the exhaust port and combustion chamber during the exhaust phase.

7 Claims, 8 Drawing Figures

ROTARY VALVE FOR INTERNAL COMBUSTION ENGINE

BACKGROUND OF THE INVENTION

This invention relates in general to internal combustion engines, and in particular relates to a rotary valve mechanism for controlling the flow of the intake and exhaust gases into and from the combustion chamber of such an engine.

Rotary valve mechanisms have previously been provided for use in controlling the flow of intake and exhaust gases into and from the cylinders of combustion engines. Certain of these mechanisms employ separate rotary valves for the intake and exhaust functions. The prior art rotary valve designs have included rotating cylinders or sleeves which control the flow of intake and exhaust gases. However, these valve designs have not been widely accepted in view of their many limitations and drawbacks. For example, previous rotary valve mechanisms have been relatively complicated and expensive, they have not provided optimum valve duration and overlap for efficient engine operation, and they have not achieved good volumetric efficiency with the result that performance is relatively poor and fuel consumption and exhaust gas emissions are relatively high. Moreover, previous rotary exhaust valves have been subject to failure because they have been continually exposed to the relatively high temperatures of the exhaust gases.

Accordingly, the need has been recognized for a new and improved rotary valve mechanism for use in internal combustion engines.

OBJECTS AND SUMMARY OF THE INVENTION

It is a general object of the invention to provide a new and improved rotary valve mechanism for an internal combustion engine which avoids or eliminates many of the limitations and drawbacks inherent in previous designs.

Another object is to provide a rotary valve arrangement of the character described which is relatively simple and inexpensive in design. The invention employs a minimum number of parts and eliminates the requirement for the various cams, camshaft, rods, tappets, rocker arms, springs, and poppet valves employed in conventional engines.

Another object is to provide a rotary valve mechanism of the character described which employs a relatively simple drive train with the valves mounted on a single shaft, as compared to the more complex valve drive arrangements such as those in engines employing separate valves for the intake and exhaust functions.

Another object is to provide a rotary valve arrangement of the character described in which a single valve controls both intake and exhaust functions for a single combustion chamber whereby the intake charge serves to cool the valve after the latter is heated by the exhaust gases.

Another object is to provide a rotary valve arrangement of the character described which achieves improved volumetric efficiency. A relatively long valve duration and overlap period is achieved by means of the configuration of the flow passage which is formed in the valve element.

The invention includes a valve element of either spherical or cylindrical configuration mounted for rotation about a transverse axis between the intake and exhaust ports at the head end of each combustion chamber of an internal combustion engine. A flow passage defined by a concaval recess formed in the outer periphery of the valve is adapted to turn with the valve into and out of register with the ports and combustion chamber. A valve drive train turns the valve at one-half of the speed of the crankshaft so that the passage is carried into simultaneous register with the intake port and combustion chamber for the intake phase, out of register with the chamber during the compression and expansion phases, and into simultaneous register with the exhaust port and chamber during the exhaust phase. The passage extends along the valve periphery with a chord angle which is sized to provide the desired amount of valve duration and overlap. Means is also provided to ignite the compressed charge within the chamber for the expansion phase of operation.

The foregoing and additional objects and features of the invention will appear from the following description in which the preferred embodiments have been set forth in detail in conjunction with the accompanying drawing.

DESCRIPTION OF THE PREFERRED EMBODIMENT

Figure 1:
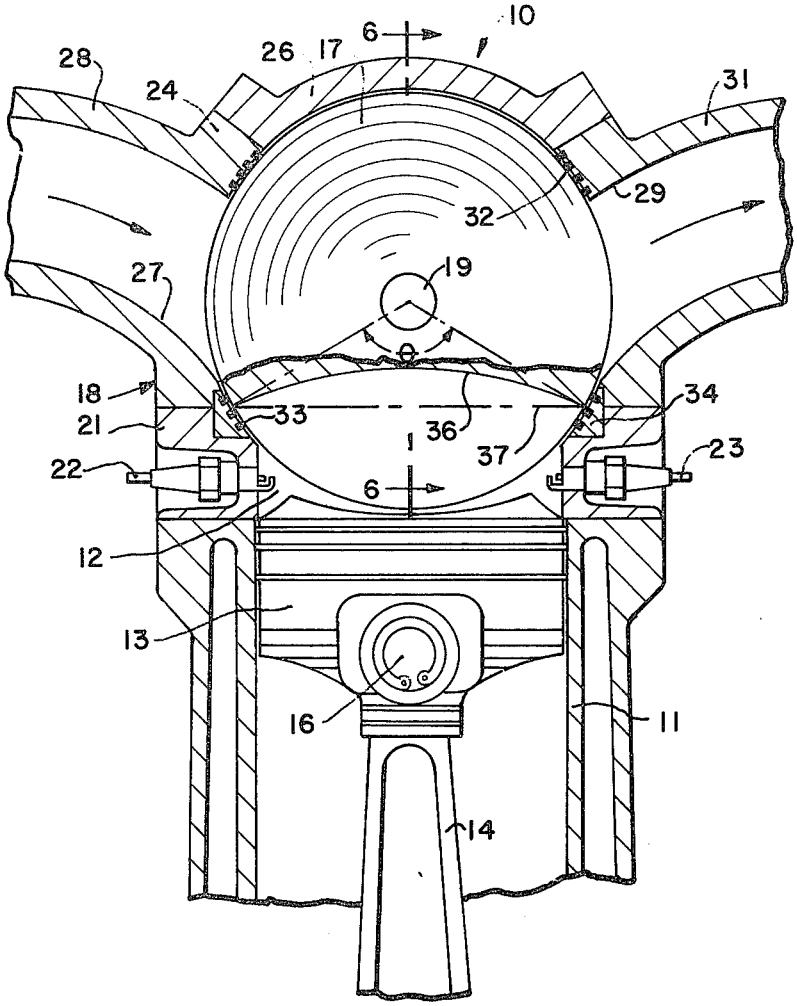
FIG. 1 is a cross sectional view of a portion of an internal combustion engine incorporating the invention.

In the drawings FIG. 1 illustrates generally at 10 a rotary valve mechanism of the invention as incorporated in an internal combustion engine of spark-ignition four-stroke cycle design. The engine includes a water-cooled cylinder 11 defining at its head end a combustion chamber 12 within which a piston 13 is adapted to reciprocate. The piston is connected to drive a crankshaft, not shown, through a connecting rod 14 mounted to the piston by means of a wristpin 16. While a single piston and its associated rotary valve mechanism is illustrated, it is understood that the invention contemplates use with an engine of either single or multiple piston design, and of either inline, flat head, Vee, or rotary cylinder configuration. In addition, while a spark-ignition carburetted charge engine operating on a four-stroke Otto cycle is illustrated, the invention also contemplates that the valve mechanism can be used with engines operating with fuel injection, or on the Diesel cycle of operation, or on a two-stroke cycle of operation.

Valve mechanism 10 includes a valve 17 of spherical configuration mounted within cylinder head 18 for rotation about a transverse axis by means of valve shaft 19. The valve shaft is rotatably carried at opposite ends of the valve on suitable bearings, not shown, mounted within the cylinder head. Where the engine is of inline cylinder design, a plurality of spherical valves can be mounted on a single valve shaft with each valve being positioned above the head end of a respective cylinder. Suitable valve drive means, not shown, such as gears, a cog belt or a drive chain is provided to drive shaft 19 and the valve at one-half of the speed of the crankshaft, where the engine is of four-stroke cycle design.

Cylinder head 18 includes a lower section 21 which is mounted above the head end of cylinder 11. Ignition means including the pair of spark plugs 22, 23 are mounted through the wall of section 21 to ignite the combustible charge within the chamber in timed relationship with movement of piston 13 by suitable voltage distributor means, not shown. A central section 24 of the cylinder head is formed with a spherical inner cavity conforming generally to the outer surface of the valve. The cylinder head includes an upper section 26 which is mounted on the central section and is formed with an inner spherical surface which also conforms with the surface of the valve. An intake port 27 is formed through one side of the central section, and this port is in communication with an intake conduit 28 leading from a suitable intake manifold and carburetor, not shown. An exhaust port 29 is formed through the opposite side of the central section and this port is in communication with a conduit 31 leading to a suitable exhaust manifold, not shown.

The upper surface of valve 17 is sealed by means of a plurality of circular labryinth seals 32 seated in circular grooves formed about the upper portion of cylinder head section 24. The labryinth seals are in fluid-sealing contact with the outer surface of the valve for precluding escape of intake and exhaust gases from the upper portion of the cylinder head.

Means is provided for sealing the lower portion of valve 17, and this means includes three rotary valve ring seals 33 mounted within a circular insert 34 seated within grooves formed about the juncture between the lower and central cylinder head sections 21 and 24. The ring seals are pressure activitated, positive contact elements which primarily function to preclude escape of gases from combustion chamber 12 during the compression and expansion phases of operation.

Figure 6:
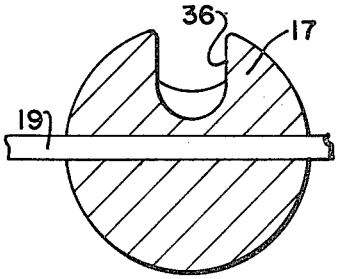
FIG. 6 is a cross sectional view taken along the lines 6—6 of FIG. 1.

A valve passage 36 comprising an outwardly facing concaval recess is formed in valve 17. As illustrated in FIG. 6 the passage extends generally in a plane normal to the axis of valve shaft 19 and is centrally positioned along the valve so that the passage moves successively into and out of register with the ports and combustion chamber. With the porting arrangement shown in FIG. 1, valve 17 is rotated clockwise by the drive means, and where intake and exhaust ports are reversed then the valve would be rotated in the opposite direction.

Passage 36 extends across a chord 37 of the outer periphery of valve 17. The chord angle $\theta$ is relatively large so that the flow volume of intake and exhaust gases is large, and also so that valve opening duration is relatively long for good intake breathing and exhaust scavenging. The particular chord angle $\theta$ which is provided will vary according to the design specifications and requirements to achieve any desired amount of valve duration, and to achieve any desired amount of valve overlap. In the embodiment illustrated in FIG. 1 the angle $\theta$ is shown as 120°. There is no valve overlap in this configuration since, with valve 17 rotated so that passage 36 faces downwardly at the close of the exhaust phase and start of the intake phase, the opposite ends of the passage are below the lower edges of the two ports.

In a four-stroke cycle engine where valve 17 is driven at one-half of the crankshaft speed, the valve duration in degrees of crankshaft rotation would be double the chord angle, i.e., 240° duration where the chord angle is 120°. For a shorter duration the chord angle of the passageway is reduced, i.e., a chord angle of 90° obtains 180° valve duration. In a valve configuration provided with a larger chord angle than that illustrated in FIG. 1, valve overlap would be created so that portions of the intake and exhaust ports are exposed to the combustion chamber at the same time. In such an arrangement, with the valve positioned as illustrated in FIG. 1, the opposite ends of the passage terminate above the lower portions of the two ports. Thus, assume that the chord angle is 150°. Valve duration would therefore be 300° of crankshaft rotation so that valve overlap would be 60° of crankshaft rotation, i.e., the excess over the valve duration where the terminal ends of the passageway register with the lower edges of the ports (occurring at 120°chord angle).

Figure 7:
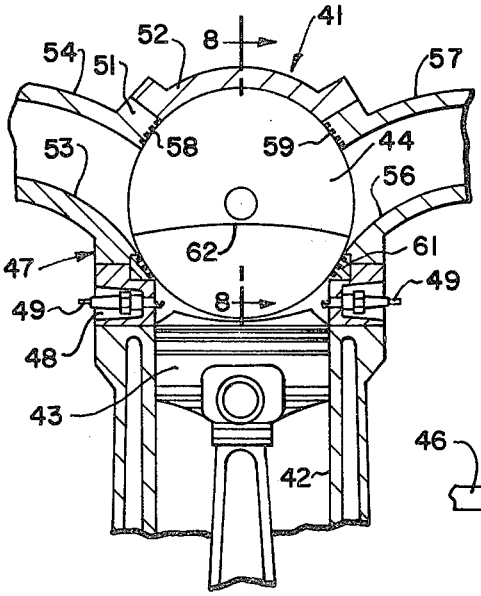
FIG. 7 is a cross sectional view of another embodiment of the invention.

FIG. 7 illustrates another embodiment of the invention providing a rotary valve mechanism 41 used with an internal combustion engine of four-stroke cycle, spark ignition design. The engine employs a cylinder 42 defining a combustion chamber within which piston 43 is adapted to reciprocate by means of a conventional crankshaft. In this embodiment the valve mechanism includes a cylindrical valve 44 mounted for rotation about a transverse axis above the head end of the combustion chamber by means of valve shaft 46. Shaft 46 is mounted within cylinder head 47 on suitable bearings and is driven by a drive train, not shown, to turn valve 44 at one-half of the crankshaft speed.

Cylinder head 47 includes a lower section 48 mounted above the head end and provided with a pair of spark plugs 49 for igniting the combustible charge. A central section 51 of the cylinder head is formed with a cylindrical bore within which the valve 44 is mounted, and an upper section 52 is mounted above the central section. One side of the central section is formed with an intake port 53 communicating with conduit 54 leading to the intake manifold and carburetor, and the opposite side is formed with an exhaust port 56 communicating with conduit 57 leading to the exhaust manifold. Elongate labryinth seals 58, 59 are mounted in the upper portion of the central section for sealing the upper surfaces of the valve, and elongate positive contact, pressure activitated seals are mounted within insert 61 which is seated in grooves formed at the interface between the central and lower sections of the cylinder head.

Figure 8:
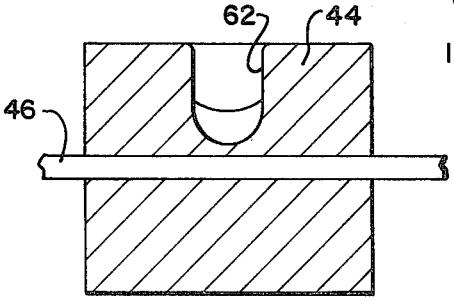
FIG. 8 is a cross sectional view taken along the line 8—8 of FIG. 7.

Valve 44 is formed with a passage 62 defined by a recess which extends generally in a plane normal to axle 46, as shown in FIG. 8. Passage 62 extends along a chord which subtends an angle $\theta$ of 150° so that, with the valve positioned as illustrated at the close of the exhaust phase and start of the intake phase, the terminal ends of the passage extend above the lower edges of the two ports. Therefore with the valve turning at one-half of the crankshaft speed, valve duration is 300° of crankshaft rotation and valve overlap is approximately 60° of crankshaft rotation.

Figure 2:
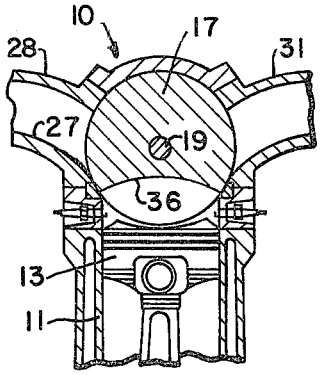
FIG. 2 is a cross sectional view similar to FIG. 1 to a reduced scale showing the elements in one operative position.
Figure 3:
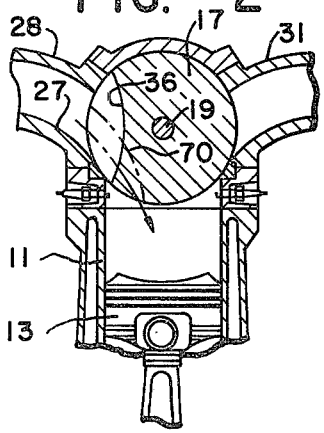
FIG. 3 is a view similar to FIG. 2 showing the elements in another operative position.
Figure 4:
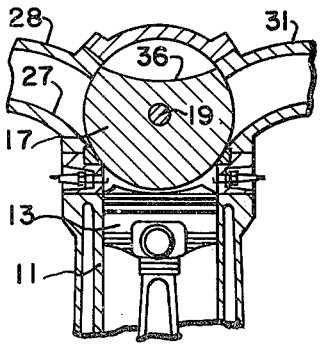
FIG. 4 is a view similar to FIG. 3 showing the elements in still another operative position.
Figure 5:
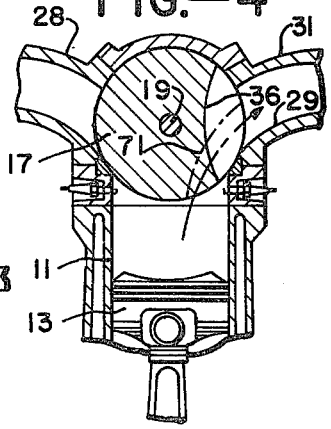
FIG. 5 is a view similar to FIG. 4 showing the elements in still another operative position.

In operation, it will be assumed that the engine of the embodiment of FIG. 1 is to be operated by inducting a charge of fuel/air mixture from a carburetor connected through a manifold with intake conduit 28. Assume that the engine's crankshaft is rotating with valve 17 turning clockwise as viewed in FIG. 2. In FIG. 2 piston 13 is at top dead center with passage 36 at the 6 o'clock position. This position of the elements is at the exact close of the exhaust phase and start of the intake phase. Continued movement of the piston downwardly toward its bottom dead center position shown in FIG. 3 causes valve 17 to rotate and carry passage 36 into simultaneous registry with intake port 27 and the combustion chamber, as illustrated by the phantom line 70. During this intake phase the fuel/air charge is inducted through the intake port into the chamber until passage 36 turns to close off the port and reaches the 9 o'clock position. The piston then moves upwardly through its compression stroke towards the top dead center position of FIG. 4. During the compression stroke the valve turns to carry passage 36 to the 12 o'clock position. The spark plugs are then energized to ignite the compressed charge for the start of the expansion phase which drives the piston downwardly toward the bottom dead center position of FIG. 5 with the passage at its 3 o'clock position. Upward movement of piston along its exhaust phase causes the valve to carry the passage into simultaneous registry with exhaust port 29 and the combustion chamber, as illustrated by the phantom line 71 of FIG. 5.

The provision of a single valve which controls the flow of both the intake charge and exhaust for a single combustion chamber results in improved cooling of the valve. The exhaust gases which flow through the valve passage when the exhaust port is open transfer heat to the valve, and during the intake phase this heat is transferred to the relatively cooler intake charge inducted through the passage from the intake port. At the same time, the intake charge is preheated for better atomization and gas mixing, with a resulting higher combustion efficiency. The invention also achieves higher volumetric efficiency by charging the combustion chamber with a greater volume of fuel/air mixture for each stroke, thereby producing a higher compression index and more complete burning of the charge. This is achieved as a result of the rapid cooling of the hot exhaust gases in the valve passage following the close of the exhaust port as the valve passage is turning through the 6 o'clock position of FIG. 2. The contraction of the cooling gases causes a partial vacuum in the volume of the passage which serves to assist in drawing in the intake charge into the combustion chamber.

Valve lift duration and valve overlap may be selectively designed into the engine by the choice of chord angle for the valve passage. In addition, varied performance may be obtained for the same engine by providing a number of interchangeable valves having passages with different chord angles.

Where the valve mechanism of the invention is used with an internal combustion engine operating with fuel injection, then a volume of fresh air is trapped within the valve passage and carried across the top of the valve during the compression and expansion strokes. During the exhaust phase with the valve turned to the position of FIG. 5 this volume of fresh air is released and mixed with the exhaust gases to assist in burning residual fuel components in the exhaust manifold and a catalytic converter, where the latter is provided.

While the foregoing embodiments are at present considered to be preferred it is understood that numerous variations and modifications may be made therein by those skilled in the art and it is intended to cover in the appended claims all such variations and modifications as fall within the true spirit and scope of the invention.

I claim:

1. In an internal combustion engine having at least one combustion chamber with a given diameter and which mounts a piston for movement through successive intake, compression, expansion and exhaust phases in a cycle of operation, the combination of a valve mounted at the head end of the combustion chamber, said valve having a circular outer periphery at least a portion of which extends across substantially the entire given diameter of the combustion chamber to completely define the head end thereof, said valve being formed at one side thereof with a concaval recess defining a passage which extends across a chord of said periphery, means forming an intake port and an exhaust port above the chamber head end, said ports being in juxtaposition to opposite sides of said valve periphery, means for moving said valve in timed relationship with movement of said piston for turning said passage into simultaneous register with the intake port and chamber for inducting a charge during the intake phase, for thereafter turning the passage out of register with the combustion chamber for the expansion phase whereby the valve serves to confine the charge within the upper end of the cylinder, and for thereafter turning the passage into simultaneous register with said exhaust port and chamber for exhausting waste gases during the exhaust phase, and means to ignite a combustible charge within the chamber for the expansion phase.

2. An engine as in claim 1 in which the periphery of the valve is formed with a spherical configuration, and said valve is mounted for rotation about an axis extending transversely between the intake and exhaust ports.

3. An engine as in claim 1 in which said periphery of the valve is formed with a cylindrical configuration extending along an axis, and said valve is mounted for rotation about said axis with the latter disposed transversely between said intake and exhaust ports.

4. An engine as in claim 1 in which said recess subtends a chord angle which is of a size sufficient to simultaneously register with portions of said intake and exhaust ports between the end of the exhaust phase and the start of the intake phase to provide valve overlap.

5. An engine as in claim 1 in which the concaval recess formed in the valve has a lateral width commensurate generally with a diameter of said combustion chamber for providing during the intake and exhaust phases a gas flow path having a cross sectional area of a large size relative to the cross sectional area of the combustion chamber to provide substantially unrestricted flow for the intake and exhaust gases.

6. An engine as in claim 1 in which the upper end of said pistion is formed with a concaval recess, and said valve is mounted in close juxtaposition with the recess of said piston.

7. An engine as in claim 1 in which said concaval recess in the valve defines, in cooperation with the respective intake and exhaust ports, flow passages which extend in arcuate paths from the combustion chamber when the valve is turned into registration between the chamber and respective intake and exhaust ports, said arcuate flow paths serving to direct the flow of the intake and exhaust gases without substantial turbulence into and from the combustion chamber.

* * * * *